US008191563B2

(12) United States Patent
Su

(10) Patent No.: US 8,191,563 B2
(45) Date of Patent: Jun. 5, 2012

(54) STEPLESS COLLAPSING MECHANISM FOR UMBRELLAS

(76) Inventor: Ping-Tung Su, Hsin-Chu (TW)

( * ) Notice: Subject to any disclaimer, the term of this patent is extended or adjusted under 35 U.S.C. 154(b) by 37 days.

(21) Appl. No.: 12/801,584

(22) Filed: Jun. 16, 2010

(65) Prior Publication Data

US 2011/0308558 A1 Dec. 22, 2011

(51) Int. Cl.
*A45B 25/00* (2006.01)

(52) U.S. Cl. ..... 135/20.3

(58) Field of Classification Search ..... 135/15.1, 135/22, 24, 25.4, 25.41, 20.3
See application file for complete search history.

(56) References Cited

U.S. PATENT DOCUMENTS

| | | | | |
|---|---|---|---|---|
| 5,174,319 | A * | 12/1992 | Chou et al. | 135/20.3 |
| 6,196,243 | B1 * | 3/2001 | Chen | 135/22 |
| 7,798,160 | B2 * | 9/2010 | Chen | 135/24 |
| 7,971,595 | B1 * | 7/2011 | Ko | 135/24 |
| 2010/0288317 | A1 * | 11/2010 | Huang | 135/24 |
| 2011/0048479 | A1 * | 3/2011 | Kuo | 135/20.3 |
| 2011/0192435 | A1 * | 8/2011 | Ko | 135/24 |
| 2011/0226295 | A1 * | 9/2011 | Lo | 135/24 |
| 2011/0232707 | A1 * | 9/2011 | Wu et al. | 135/22 |

* cited by examiner

*Primary Examiner* — Noah Chandler Hawk

(57) ABSTRACT

A collapsing mechanism for umbrellas includes a transmission member and a movable member which is engaged with the transmission member to stop the mechanism from being stopped during the action and the umbrella does not opened suddenly to hurt people. During the collapsing action, the action can be stopped as desired and the umbrella is maintained at that status and does not open. By the mechanism, the user does not need to complete the collapsing action at one time.

8 Claims, 7 Drawing Sheets

STEPLESS COLLAPSING MECHANISM FOR UMBRELLAS

BACKGROUND OF THE INVENTION (1) Field of the Invention

The present invention relates to a collapsing mechanism for umbrellas, and more particularly, to a stepless collapsing mechanism for umbrellas.

(2) Description of the Prior Art

A conventional umbrella includes a runner movably mounted to the shaft of the umbrella and multiple stretchers are pivotably connected between the runner and the gore. The user has to move the runner from the lower end of the shaft to the top of the shaft to expand the umbrella. In order to expand the stretchers quickly, an automatic device is developed and which includes a spring in the shaft so that when the umbrella is folded, the spring is in an extended status, and a control button located at the handle positions the spring. When the control button is pushed, the spring is disengaged from the hook that holds the spring in its extended status, and the spring force brings the runner upward along the shaft so that the stretchers are expanded.

However, when folding the umbrella, the user has to pull the runner downward along the shaft to allow the hook to hold the spring and this action requires a certain level of force to overcome the spring force. This is not convenient for some users who do not have too much muscle power. Besides, it happens often that the user's hand is wet and the runner slip away from the user's hand during pulling it downward, and the umbrella will suddenly opened and this may hurt the user or the people standing beside the user.

The present invention intends to provide a umbrella collapsing mechanism to improve the shortcomings of the conventional automatic umbrella.

SUMMARY OF THE INVENTION

The present invention relates to a collapsing mechanism for umbrellas, and the mechanism comprises a base, a movable member, a transmission member, an operation member, a sleeve and a handle. By pressing the movable member by the shaft, the movable member is engaged with the transmission member such that the transmission member can only be pivoted in one direction. Accordingly, the collapsing action of the umbrella can be stopped temporarily while the umbrella does not open suddenly.

The collapsing mechanism for umbrellas, and the mechanism comprises a base having a neck which extends from a first end of the base and defines a hole, and a second end of the base is an open end. A movable member is an F-shaped member when viewed from a side thereof. The movable member includes a through hole, a first arm, two second arms and a bar. The first arm and the two second arms extend from an upright portion of the movable member and the through hole is defined in a lower end of the upright portion of movable member. The bar is located in the upright portion and located at a top of the through hole. A transmission member has a spool which includes a ratchet on an outside thereof and a cable is wrapped to the spool. An operation member has a window, a pivotal plate and a pin. The operation member has an inside wall at a rear side thereof so as to cover a rear lower portion of a rear side of the window. A fixed member extends from the inside wall and is accessible from a front of the window. A hollow and cylindrical handle has an aperture in a wall thereof and a block is connected to an inner periphery of the handle. A hollow and cylindrical sleeve is mounted to the base and located in the handle. The operation member, the movable member, the transmission member and the base are received in the sleeve in sequence.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
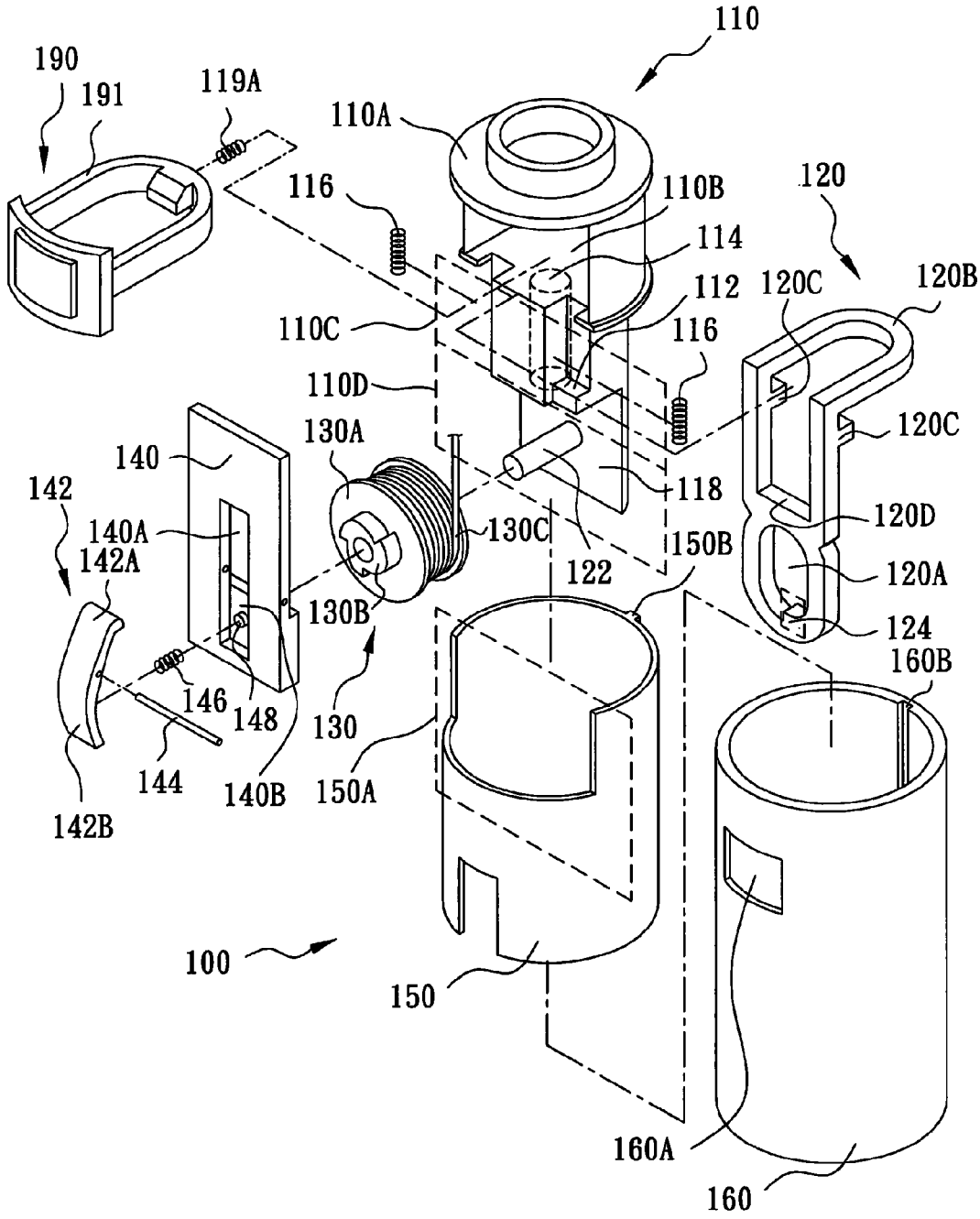
FIG. 1 is an exploded view to show the collapsing mechanism of the present invention.
Figure 2:
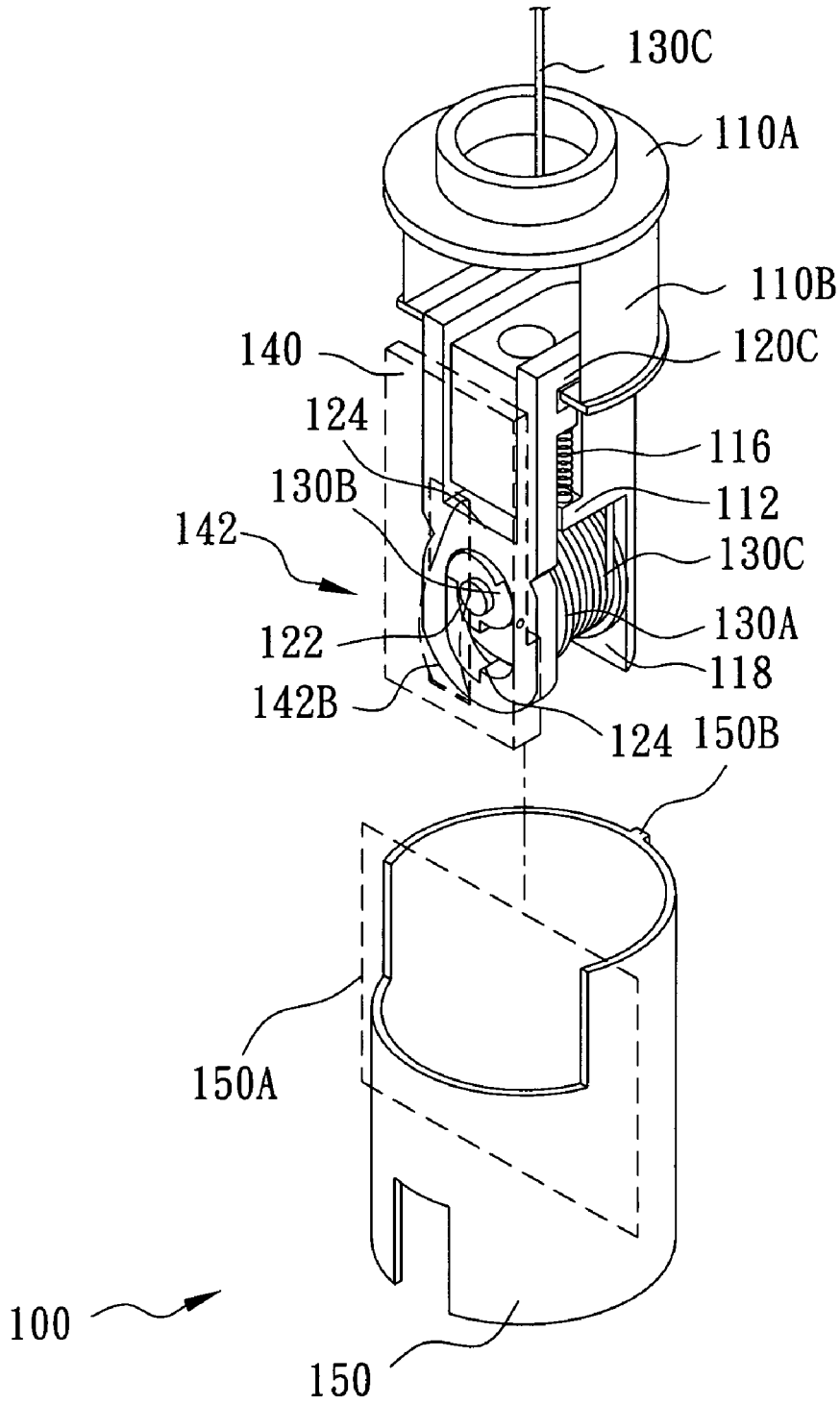
FIG. 2 is another exploded view to show the collapsing mechanism of the present invention.
Figure 3:
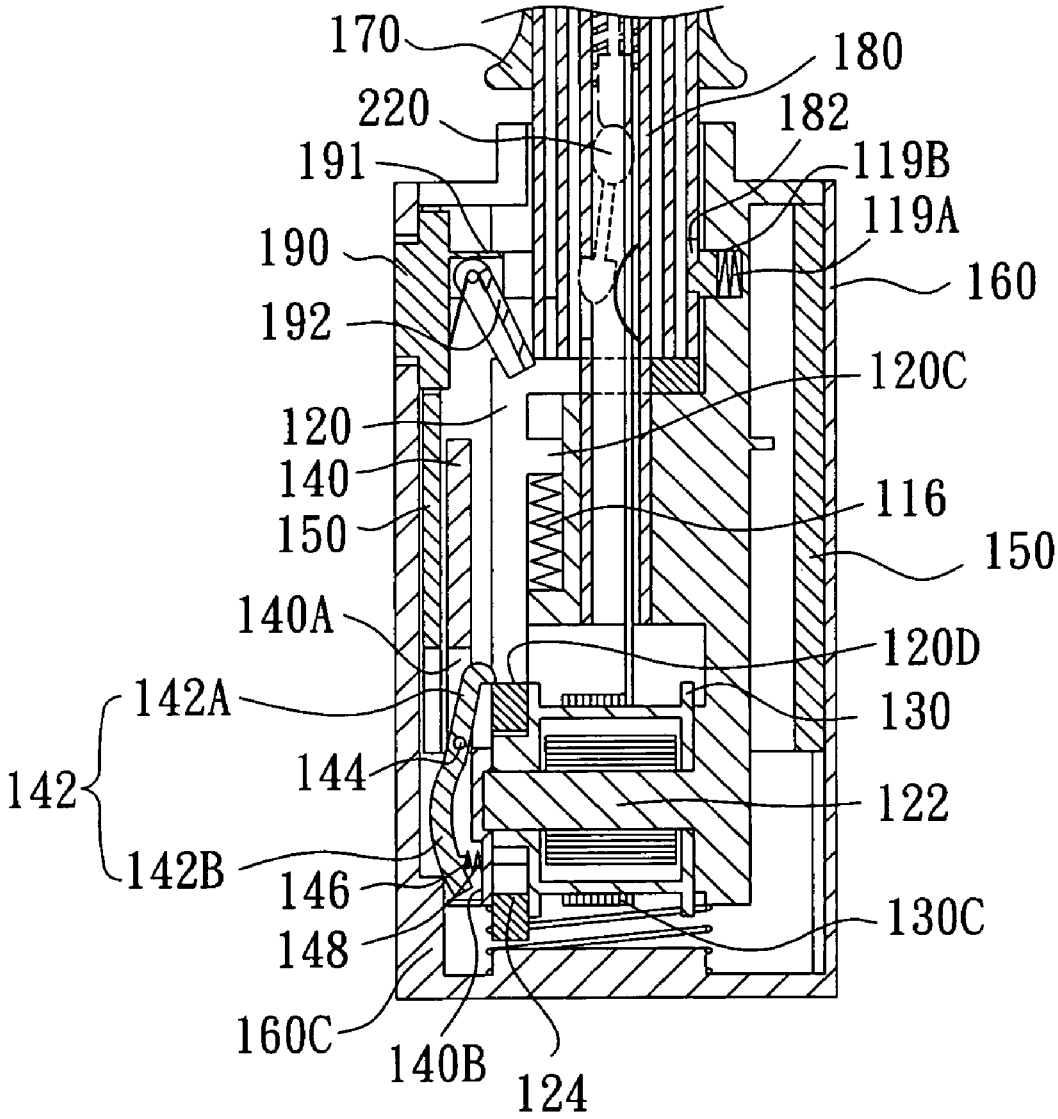
FIG. 3 is a cross sectional view of the collapsing mechanism of the present invention, wherein the umbrella is not yet opened.

Referring to FIGS. 1 to 3, the collapsing mechanism 100 for umbrellas of the present invention comprises a base 110, a movable member 120, a transmission member 130, an operation member 140, a sleeve 150 and a handle 160. The base 110 has a neck 110A which extends from a first end of the base 110 and defines a hole and a second end of the base 110 is an open end. The shaft 180 of the umbrella extends through the neck 110A. The base 110 comprises a chamber 110B, an operation area 110C and a transmission area 110D.

The chamber 110B is used to accommodate some parts of the movable member 120 to move therein and the chamber 110B is located between the neck 110A and an M-shaped unit. The operation area 110C is located beneath the chamber 110B and separated from the chamber 110B by the M-shaped unit. The wall of the chamber 110B is a half circular wall.

There are multiple stops 112 are located in the operation area 110C and connected to a lower portion of the M-shaped unit. The operation area 110C comprises a passage 114 which extends through the operation area 110C and communicates with the chamber 110B and the transmission area 110D. The space located above each of the stops 112 has a first spring 116 located therein and the stop 112 contacts a lower end of the first spring 116. The cable 130C extends through the passage 114 and the neck 110A and extends out from the base 110.

The transmission area 110D is the open end of the base 110 and has a reception portion 118 from which a rod 122 extends so that the transmission member 130 is connected to the rod 122. The transmission member 130 has a spool 130A which includes a ratchet 130B on an outside thereof. A cable 130C is wrapped to the spool 130A and the other end of the cable 130C extends through the passage 114 and the neck 110A and extends out from the base 110 to be connected with the top cap 200 (FIG. 3) of the umbrella.

The movable member 120 is an F-shaped member when viewed from a side thereof. The movable member 120 includes a through hole 120A, a first arm 120B, two second arms 120C and a bar 120D. The first arm 120B and the two second arms 120C extend from an upright portion of the movable member 120 to form the two transverse bars of the F-shaped member and the through hole 120A is defined in a lower end of the upright portion of movable member 120. The bar 120D is located in the upright portion and located at a top of the through hole 120A. A pawl 124 is located at a lower portion of the through hole 120A and the first arm 120B is located in the chamber 110B. The two second arms 120C are located to contact two respective top ends of the first springs 116. The ratchet 130B of the transmission member 130 is located in the through hole 120A, and the pawl 124 is engaged with the ratchet 130B.

The operation member 140 has a window 140A, a pivotal plate 142 and a pin 144. The operation member 140 has an inside wall 140B at a rear side thereof so as to cover a rear lower portion of a rear side of the window 140A. A fixed member 148 extends from the inside wall 140B and is accessible from a front of the window 140A. A second spring 146 has a first end fixed to the fixed member 148 on the inside wall 140B. The pivotal plate 142 comprises a first plate 142A and a second plate 142B which is connected to the first plate 142A at an angle. A pin 144 is connected between a conjunction portion of the first and second plates 142A, 142B. Two ends of the pin 144 are pivotably connected to two insides of the window 140A, so that the pivotal plate 142 can be pivoted about the pin 144. A second end of the second spring 146 contacts the rear side of the second plate 142B of the pivotal plate 142. The first plate 142A of the pivotal plate 142 constantly extends through the top portion of the window 140A and is engaged with the bar 120D when the pivotal plate 142 is not operated.

The handle 160 is a hollow and cylindrical handle and has an aperture 160A in a wall thereof and a block 160C is connected to an inner periphery of the handle 160. The block 160C of the handle 160 is in contact with the second plate 142B when no force is applied to the pivotal plate 142 as shown in FIG. 2. The handle 160 has an axial groove 160B defined in the inner periphery thereof.

The sleeve 150 is a hollow and cylindrical sleeve which is mounted to the base 110 and located in the handle 160. The operation member 140, the movable member 120, the transmission member 130 and the base 110 are received in the sleeve 150 in sequence. The sleeve 150 has a notch defined in a top portion thereof and the notch is cooperated with the aperture 160A of the handle 160 to form an opening 150A. The sleeve 150 further has a rail 150*b* on an outside thereof, the rail 150B is slidably engaged with the groove 160*b* so that the handle 160 is movable relative to the sleeve 150.

Referring to FIG. 3, the umbrella includes the shaft 180 which is fixed to the base 110 and composed of multiple sections retractably connected to each other. An operation spring 181 is located in the shaft 180 and the top cap 200 is connected to the top end of the shaft 180. A runner 170 is movably mounted to the shaft 180 is multiple stretchers 120 are pivotably connected between the top cap 200 and the runner 170. An inner piece 220 is located in the shaft 180 is connected to the top cap 200. A push member 190 is connected to the shaft 180 and is used to control the use of the umbrella. The lower end of the shaft 180 has an engaging hole 182 and the push member 190 is installed to the aperture 160A in the handle 160. The push member 190 includes a switch 192 and a U-shaped portion 191. The switch 192 is pivotably connected to a mediate portion of the push member 190 and the U-shaped portion 191 is engaged with the engaging hole 182 of the shaft 180. The U-shaped portion 191 is installed to the recess 119B in the chamber 110B by a third spring 119A so as to allow the U-shaped portion 191 to move in the recess 119B.

Figure 4:
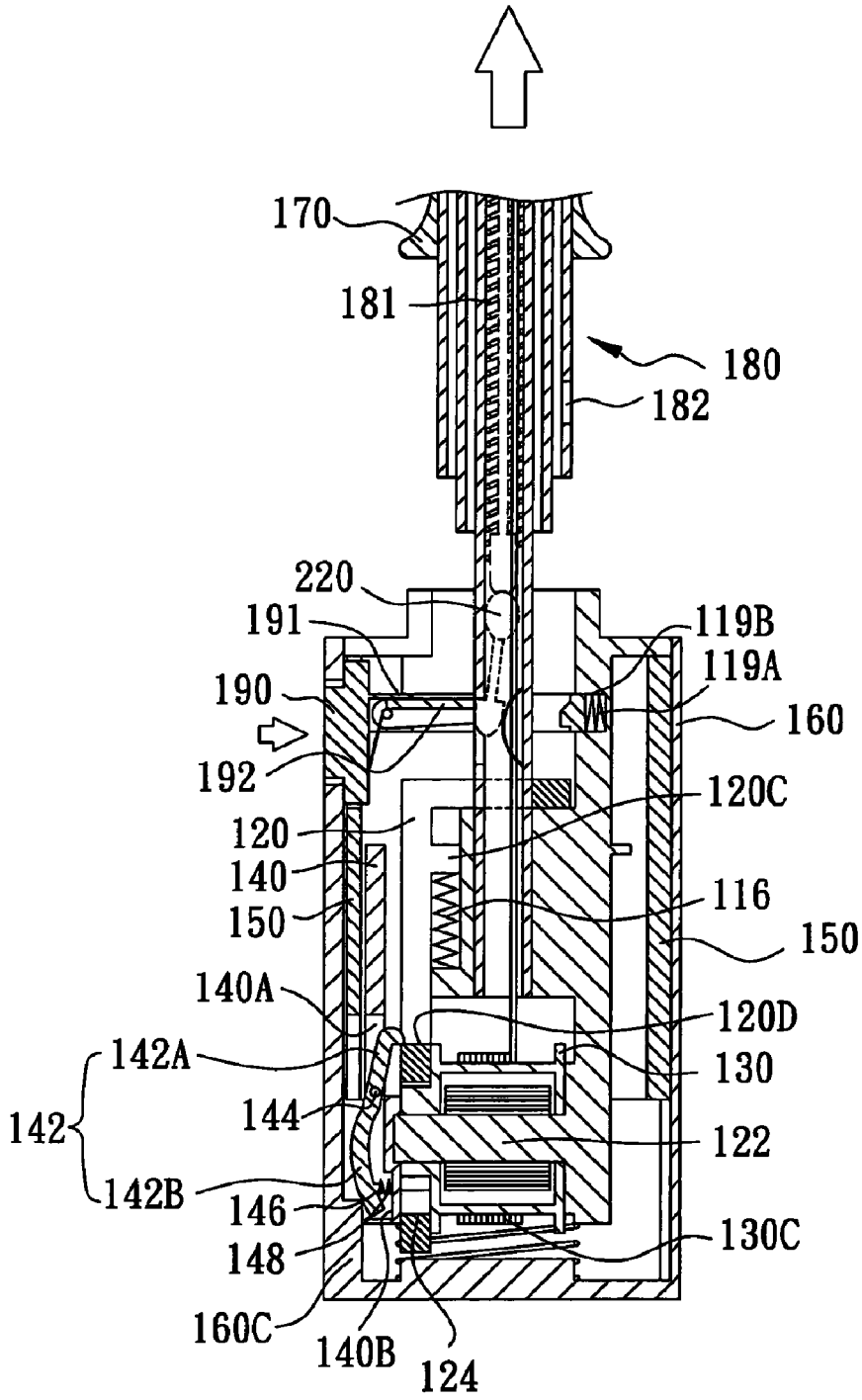
FIG. 4 is a cross sectional view of the collapsing mechanism of the present invention, wherein the umbrella starts to be opened.

When the umbrella is to be opened, as shown in FIG. 4, the push member 190 is pushed and the U-shaped portion 191 is pushed toward the recess 119B of the chamber 110B. The U-shaped portion 191 is disengaged from the engaging hole 182 of the shaft 180 and the operation spring 181 pulls the sections of the shaft 180 to an operation status. The first plate 142A of the pivotal plate 142 is engaged with the bar 120D of the movable member 120 and the pawl 124 in the through hole 120A of the movable member 120 is not engaged with the ratchet 130 of the transmission member 130. Therefore, the spool 130A is able to freely rotate in both directions and the cable 130C is pulled along with the shaft 180 and the top cap 200.

Figure 5:
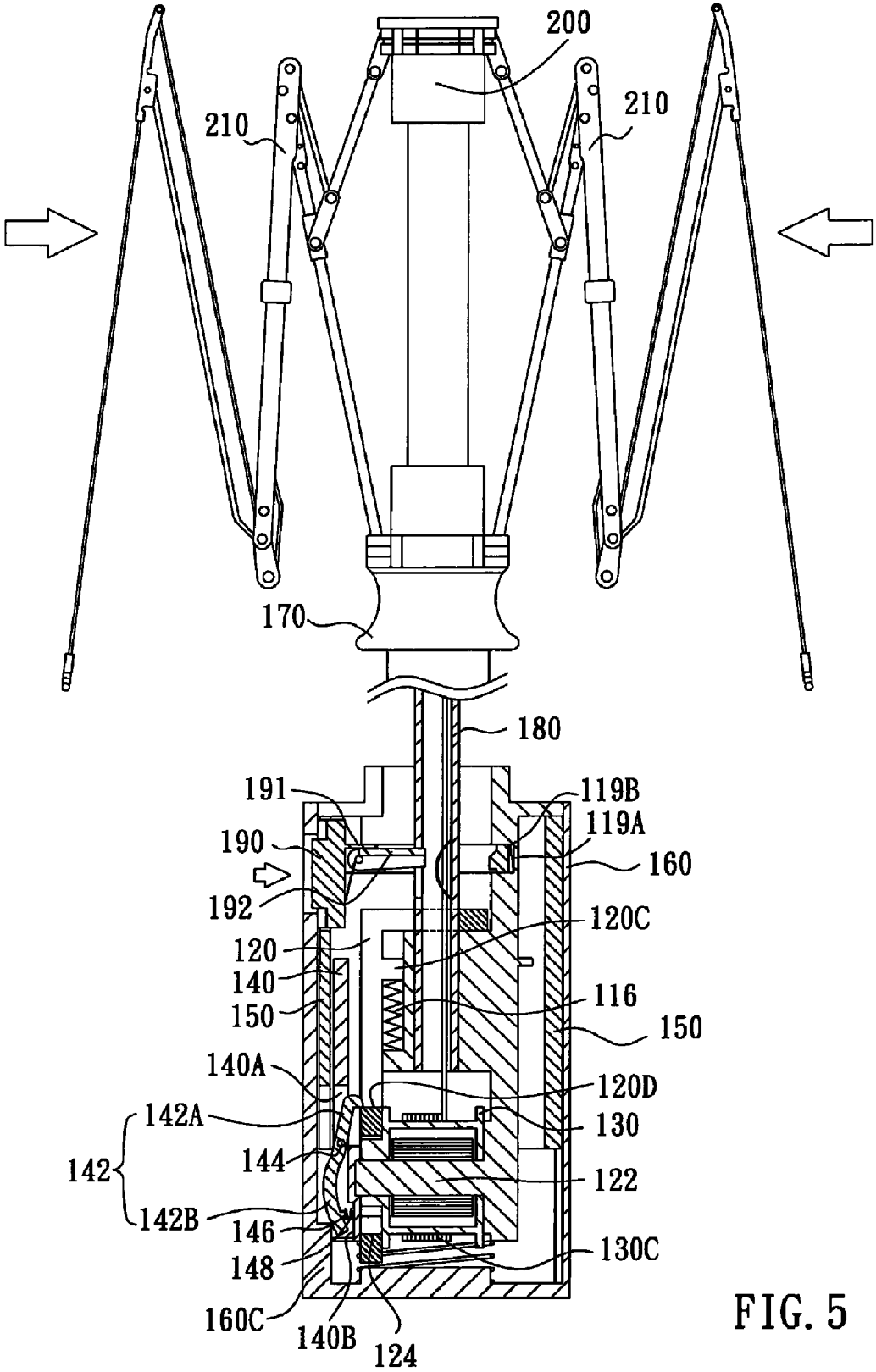
FIG. 5 is a cross sectional view of the collapsing mechanism of the present invention, wherein the umbrella starts to be collapsed.

When the push member 190 is pushed and the umbrella is completely opened, as shown in FIG. 5, the inner piece 220 in the shaft 180 is exposed so that when the push member 190 is pushed again, the switch 192 pushes the inner piece 220 which moves upward and the stretchers are then pivoted and folded.

Figure 6:
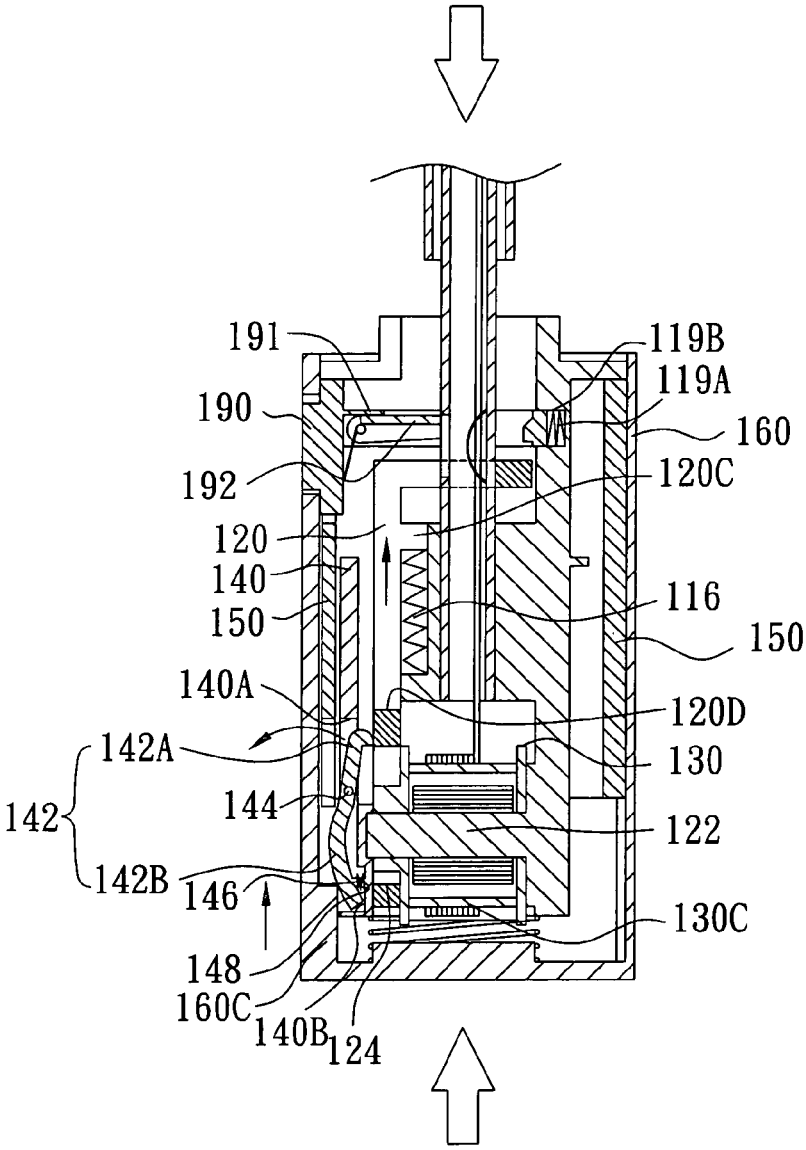
FIG. 6 is a cross sectional view of the collapsing mechanism of the present invention, wherein the umbrella is collapsing.
Figure 6A:
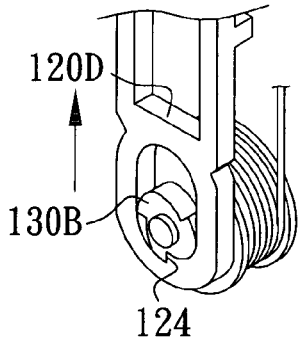
FIG. 6A shows that the pawl of the movable member is engaged with the ratchet of the transmission member.

Further referring to FIGS. 6 and 6A, when retracting the shaft 180, the user pulls the umbrella toward the handle 160 and the handle 160 moves in the opposite direction of the direction that the shaft 180 and gore are collapsed. The block 160C presses the second plate 142B to pivot the pivotal plate 142 so that the first plate 142A disengages the movable member 120 from the bar 120D. The movable member 120 is released and the pawl 124 in the through hole 120A of the movable member 120 is engaged with the ratchet 1308 to restrict the transmission member 130 to move only in one direction.

Figure 7:
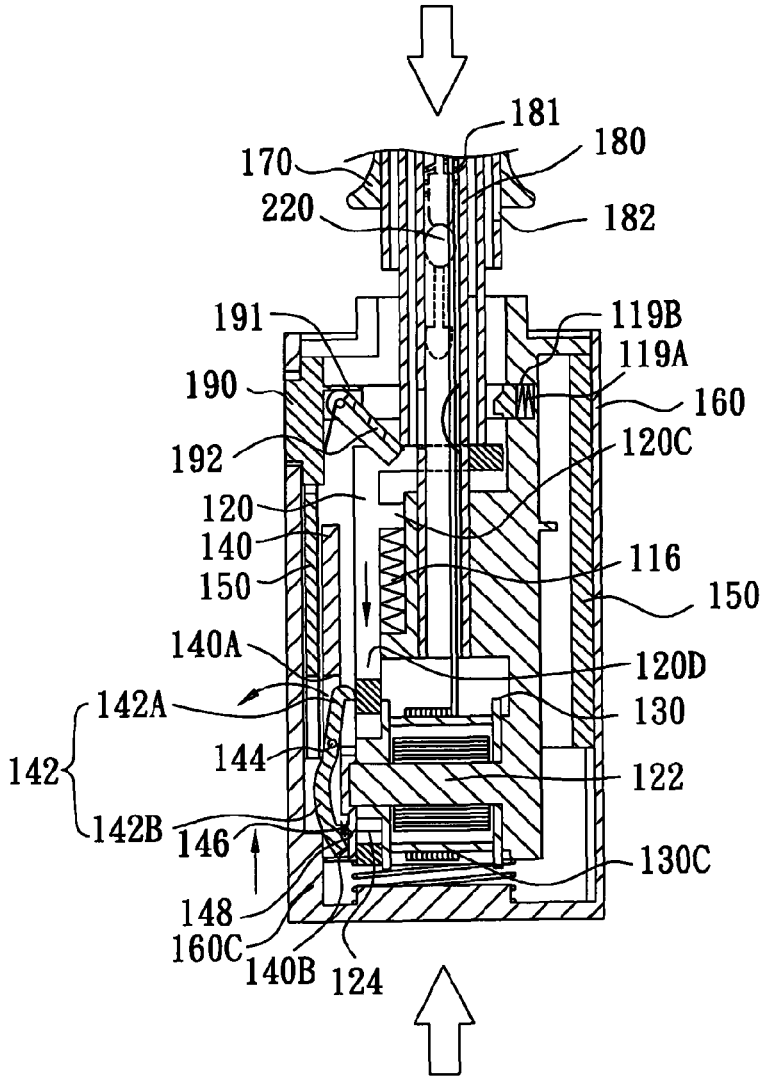
FIG. 7 is a cross sectional view of the collapsing mechanism of the present invention, wherein the umbrella is collapsed.
Figure 7A:
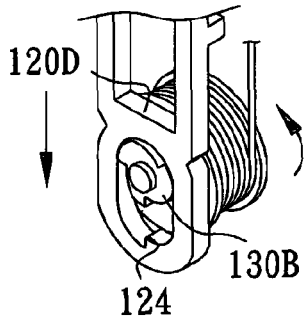
FIG. 7A shows that the pawl of the movable member is disengaged from the ratchet of the transmission member.

Referring to FIGS. 7 and 7A, when the shaft 180 is retracted, the shaft 180 presses the first arm 120B of the movable member 120 and the movable member 120 is moved back with the shaft 180 to release the pawl 124 in the through hole 120A of the movable member 120 from the ratchet 130B as shown in FIG. 7A, and the spool 130A is freely rotatable. The cable 130C pulls the top cap 200 by the rotation of the spool 130A such that the user does not need to exert too much force to retract the shaft 180. After the shaft 180 is retracted completely, the U-shaped portion 191 of the push member 190 is again engaged with the engaging hole 182 of the shaft 180, and the first plate 142A is engaged with the bar 120D. The umbrella is completely collapsed and the mechanism is in its initial status as shown in FIG. 3. Besides, even if the collapsing action is suddenly stopped during collapsing the umbrella, the force that applied to the first arm 120B of the movable member 120 is disappeared, the two first springs 116 on two sides of the movable member 120 provide a force 120 to let the pawl 124 be engaged with the ratchet 130B again as shown in FIG. 6A. Therefore, the umbrella can be held at the status because of the engagement of the pawl 124 and the ratchet 130B. This prevents the umbrella opens suddenly.

While we have shown and described the embodiment in accordance with the present invention, it should be clear to those skilled in the art that further embodiments may be made without departing from the scope of the present invention.

What is claimed is:

1. A collapsing mechanism for umbrellas, comprising:

a base having a neck which extends from a first end of the base and defines a hole, a second end of the base being an open end;

a movable member being an F-shaped member when viewed from a side thereof, the movable member including a through hole, a first arm, two second arms and a bar, the first arm and the two second arms extending from an upright portion of the movable member and the through hole defined in a lower end of the upright portion of movable member, the bar located in the upright portion and located at a top of the through hole;

a transmission member having a spool which includes a ratchet on an outside thereof, a cable wrapped to the spool;

an operation member having a window, a pivotal plate and a pin, the operation member having a inside wall at a rear side thereof so as to cover a rear lower portion of a rear side of the window, a fixed member extending from the inside wall and being accessible from a front of the window;

a hollow and cylindrical handle having an aperture in a wall thereof and a block connected to an inner periphery of the handle, and a hollow and cylindrical sleeve mounted to the base and located in the handle, the operation member, the movable member, the transmission member and the base being received in the sleeve in sequence.

2. The mechanism as claimed in claim 1, wherein the base comprises a chamber, an operation area is located beneath the chamber and separated from the chamber, multiple stops are located in the operation area, a transmission area is the open end of the base and has a reception portion from which a rod extends so that the transmission member is connected to the rod, wherein the operation area comprises a passage which extends through the operation area and communicates with the chamber and the transmission area, space located above each of the stops has a first spring located therein and the stop contacts a lower end of the first spring, the cable extends through the passage and the neck and extends out from the base.

3. The mechanism as claimed in claim 2, wherein a pawl is located at a lower portion of the through hole and the first arm is located in the chamber, the two second arms are located to contact two respective top ends of the first springs, the ratchet of the transmission member is located in the through hole, the pawl is engaged with the ratchet.

4. The mechanism as claimed in claim 1, wherein the pivotal plate comprises a first plate and a second plate which is connected to the first plate at an angle, a pin is connected between a conjunction portion of the first and second plates, two ends of the pin are pivotably connected to two insides of the window.

5. The mechanism as claimed in claim 4, wherein a second spring has a first end fixed to the fixed member on the inside wall and a second end of the second spring contacts the rear side of the second plate of the pivotal plate, the first plate of the pivotal plate constantly extends through the top portion of the window and is engaged with the bar when the pivotal plate is not operated, the block of the handle is in contact with the second plate.

6. The mechanism as claimed in claim 1, wherein the sleeve has a notch defined in a top portion thereof and the notch is cooperated with the aperture of the handle to form an opening.

7. The mechanism as claimed in claim 1, wherein the handle has an axial groove defined in the inner periphery thereof and the sleeve has a rail on an outside thereof, the rail is slidably engaged with the groove so that the handle is movable relative to the sleeve.

8. The mechanism as claimed in claim 1, wherein the handle has a push member which is located in the aperture of the handle and the push member has a switch and a U-shaped portion, the switch is pivotably connected to a mediate portion of the push member and the U-shaped portion is engaged with a shaft, the U-shaped portion is installed to the recess in the chamber by a third spring so as to allow the U-shaped portion to move in the recess.

* * * * *